US009957818B2

(12) United States Patent
Martin, Jr. et al.

(10) Patent No.: US 9,957,818 B2
(45) Date of Patent: May 1, 2018

(54) REMOVABLY ATTACHABLE SNUBBER ASSEMBLY

(71) Applicant: Siemens Energy, Inc., Orlando, FL (US)

(72) Inventors: Nicholas F. Martin, Jr., York, SC (US); David J. Wiebe, Orlando, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 349 days.

(21) Appl. No.: 14/838,645

(22) Filed: Aug. 28, 2015

(65) Prior Publication Data

US 2017/0058681 A1 Mar. 2, 2017

(51) Int. Cl.
*F01D 5/22* (2006.01)
*F01D 5/18* (2006.01)

(52) U.S. Cl.
CPC ..... *F01D 5/22* (2013.01); *F01D 5/18* (2013.01); *F01D 5/225* (2013.01); *F05D 2220/3215* (2013.01); *F05D 2230/60* (2013.01); *F05D 2260/20* (2013.01); *F05D 2260/96* (2013.01)

(58) Field of Classification Search
CPC ... F01D 5/22; F01D 5/225; F01D 5/24; F01D 5/18; F05D 2220/3215; F05D 2230/60; F05D 2240/30; F05D 2260/20; F05D 2260/96; F05D 2260/961
See application file for complete search history.

(56) References Cited

U.S. PATENT DOCUMENTS

| | | | | |
|---|---|---|---|---|
| 5,267,834 | A * | 12/1993 | Dinh | F01D 5/141 416/191 |
| 5,445,498 | A * | 8/1995 | Williams | F01D 5/141 416/191 |
| 8,523,525 | B2 * | 9/2013 | Marra | F01D 5/187 416/196 R |
| 2010/0135812 | A1 * | 6/2010 | Cairo | B23P 6/005 416/223 A |
| 2011/0158810 | A1 * | 6/2011 | Shibukawa | F01D 1/04 416/196 |
| 2011/0194943 | A1 * | 8/2011 | Mayer | F01D 5/187 416/97 R |
| 2014/0056716 | A1 * | 2/2014 | Messmann | F01D 5/22 416/96 R |
| 2016/0040537 | A1 * | 2/2016 | Spracher | F01D 5/225 416/196 R |

* cited by examiner

*Primary Examiner* — Mark Laurenzi
*Assistant Examiner* — Xiaoting Hu

(57) ABSTRACT

A removably attachable snubber assembly for turbine blades includes a turbine blade airfoil including a trailing edge and a leading edge joined by a pressure side and a suction side to provide an outer surface extending in a radial direction to a tip. At least one snubber attachment platform is integrally formed onto the outer surface of the turbine blade airfoil. The at least one snubber attachment platform includes an interlocking mechanism. A snubber is removably attachable to the at least one snubber attachment platform, the snubber including a first end, a second end, a trailing edge, a leading edge, a snubber length, and a snubber width. The snubber also includes a removable attachment mechanism on at least one of the first end and the second end that connects with the interlocking mechanism on the at least one snubber attachment platform.

16 Claims, 8 Drawing Sheets

FIG 8
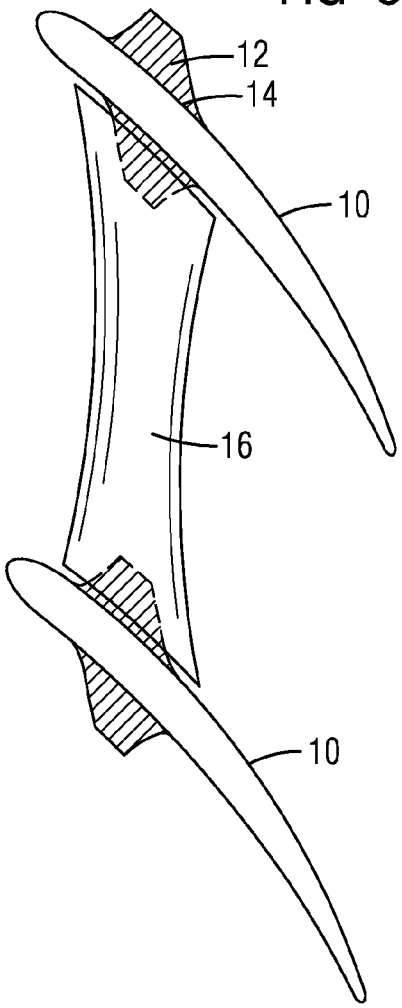
FIG 9
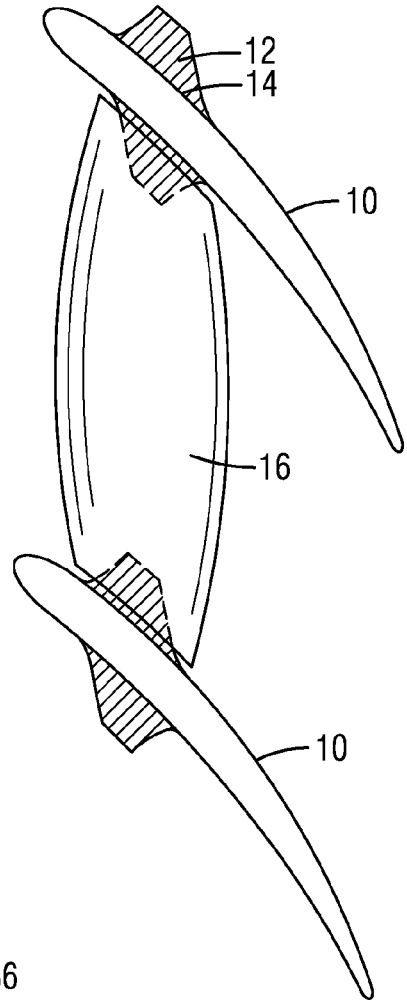
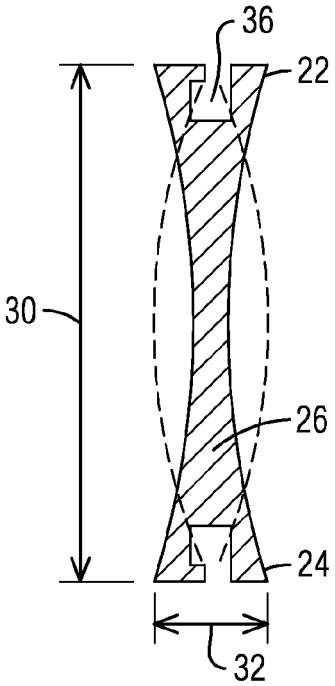
FIG 10
View B-B

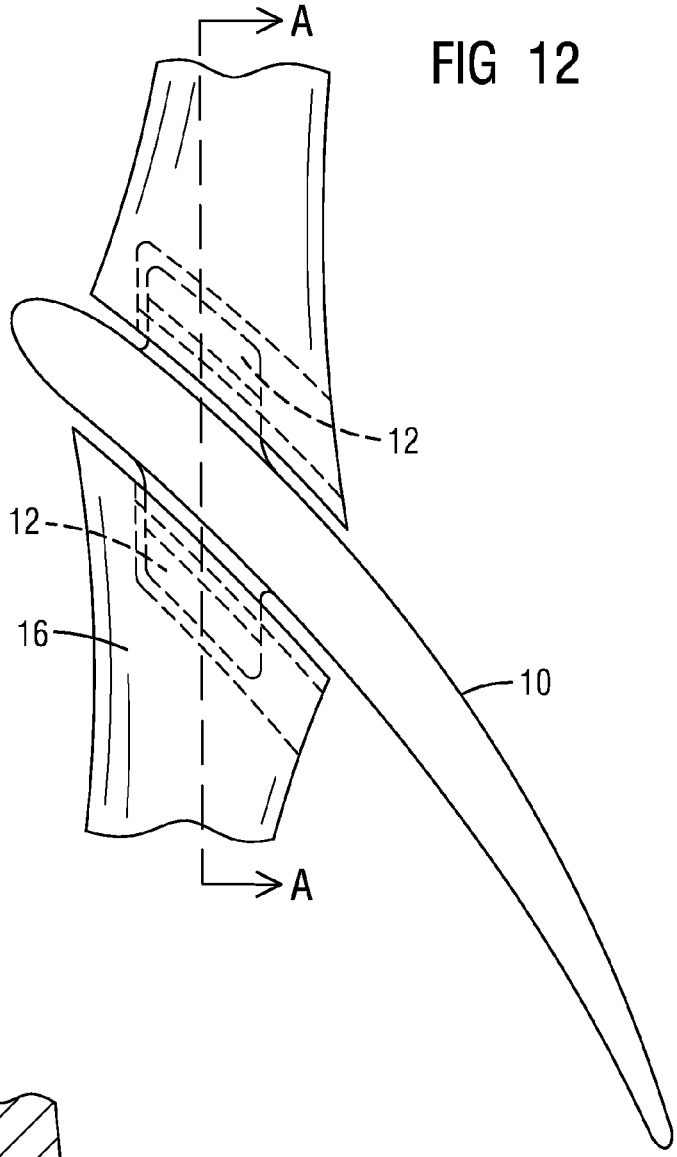
FIG 12
FIG 13
View A-A
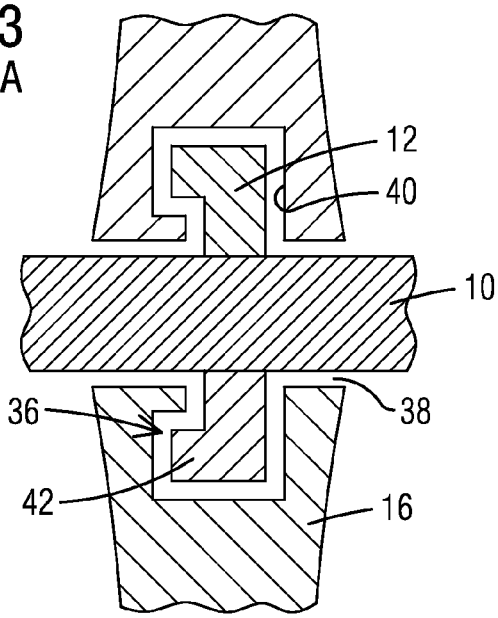

View E-E

View E-E

View E-E

View C-C

View A-A

REMOVABLY ATTACHABLE SNUBBER ASSEMBLY

STATEMENT REGARDING FEDERALLY SPONSORED RESEARCH

Development of this invention was supported in part by the United States Department of Energy, Contract No. DE-FE0023955. Accordingly, the United States Government may have certain rights in this invention.

BACKGROUND

1. Field

The present invention relates to gas turbine engines, and more specifically to a removably attachable snubber assembly for a turbine blade.

2. Description of the Related Art

In an industrial gas turbine engine, hot compressed gas is produced. The hot gas flow is passed through a turbine and expands to produce mechanical work used to drive an electric generator for power production. The turbine generally includes multiple stages of stator vanes and rotor blades to convert the energy from the hot gas flow into mechanical energy that drives the rotor shaft of the engine. Turbine inlet temperature is limited to the material properties and cooling capabilities of the turbine parts. This is especially important for upstream stage turbine vanes and blades since these airfoils are exposed to the hottest gas flow in the system.

A combustion system receives air from a compressor and raises it to a high energy level by mixing in fuel and burning the mixture, after which products of the combustor are expanded through the turbine.

Since the turbine vanes and blades are exposed to the hot gas flow discharged from combustors within the combustion system, cooling methods are sometimes used to obtain a useful design life cycle for the turbine blade or vane. Blade and vane cooling is accomplished by extracting a portion of the compressed air from the compressor and directing it to the turbine section, thereby bypassing the combustors. After introduction into the turbine section, this cooling air flows through passages formed in the airfoil portions of the blades and vanes.

Gas turbines are becoming larger, more efficient, and more robust. Large blades and vanes are being produced, especially in the hot section of the engine system. Of particular challenge is the last stage blade. Traditionally the last stage blade has been solid, tip shrouded and uncooled. This configuration has limitations as the blades require more robustness as the gas path diameters increase and the gas path temperatures increase.

In order to allow for increasing the gas path diameter, turbine blades may be hollow, cooled, curve root attached blades with integral part span snubbers as seen in FIGS. 1 through 3. FIGS. 2 and 3 shows multiple blades and snubbers in a conventional configuration. There is an extensive amount of time and effort involved with making sure the snubbers are properly aligned and within a certain distance in order to make eventual contact once the turbine blades are moving at a certain speed. The turbine snubbers are also used for the purpose of damping blade mechanical vibrations, particularly for blades having high aspect ratio. An edge from each snubber is a contact surface for the next snubber once the turbine blades are moving at a specific rotational speed.

The snubber creates an assembly challenge due to the potential interference between the attachment engagement and snubber contact surface engagement as can be seen in FIGS. 1 and 2. The assembly cannot be completed without specialized tooling and processes. The existing snubber systems are all axisymmetric forming a constant radius, segmented support ring for the large blades. The damping design criteria for bearing angle and contact pressure are often difficult to achieve. The snubber also presents a performance challenge due to the increased aerodynamic blockage as well as its effect on the exhaust diffuser behavior. Assembly issues in regards to the snubbers and the eventual connections are difficult, especially since contact is not made until the turbine blades have started to move at a certain rotational speed.

In current assemblies, the snubbers will connect with each other once the turbine is up and running at a particular rotational speed. The blade untwists as a functional of rotational speed. The airfoil will also have radial growth at increased rotational speeds. Once the blades have sufficiently untwisted, the snubbers come into contact through their contact surfaces once that particular rotational speed is met as shown in FIG. 2. The contact surface, or bearing surface, on each snubber connects once a certain rotational speed is reached. There is typically no initial contact of the snubbers at zero and low speeds as is shown in FIG. 3.

Aeromechanical systems for snubbers and tip shrouds consider the vibratory mode shape to define the bearing angle and contact pressure to achieve the required level of mechanical constraint and damping. Additionally, these systems try to achieve minimum weight to reduce the stress on the blade. There has been no significant reduction in the snubber aerodynamic penalty because of the mechanical requirements for blade support and part life.

SUMMARY

In one aspect of the present invention, a removably attachable snubber assembly for turbine blades comprises: a turbine blade airfoil comprising a trailing edge and a leading edge joined by a pressure side and a suction side to provide an outer surface extending in a radial direction to a tip; at least one snubber attachment platform integrally formed onto the outer surface of the turbine blade airfoil, wherein the at least one snubber attachment platform comprises an interlocking mechanism; and a snubber comprising a first end, a second end, a trailing edge, a leading edge, a snubber length, and a snubber width, wherein the snubber is removably attachable to the at least one snubber attachment platform, wherein the snubber comprises a removable attachment mechanism on at least one of the first end and the second end, wherein the removable attachment mechanism on the snubber connects with the interlocking mechanism on the at least one snubber attachment platform, the interlocking mechanism constructed to provide a contact surface for the snubber and a clearance gap for operational blade movement.

In another aspect of the present invention, a rotor assembly comprises: a disc comprising a plurality of elongated channels provided therein and spaced along a disc periphery; a plurality of turbine blade airfoils, each comprising a trailing edge and a leading edge joined by a pressure side and a suction side to provide an outer surface extending in a radial direction to a tip, wherein each turbine blade airfoil is installed in each of the elongated channels on the disc; at least one snubber attachment platform integrally formed onto the outer surface of each turbine blade airfoil, wherein the at least one snubber attachment platform comprises an interlocking mechanism; and a plurality of snubbers each comprising a first end, a second end, a trailing edge, a leading edge, a snubber length, and a snubber width, wherein each snubber is removably attachable to at least one snubber attachment platform, wherein each snubber comprises a removable attachment mechanism on at least one of the first end and the second end, wherein each removable attachment mechanism on each snubber connects with the interlocking mechanism on each of the at least one snubber attachment platform, the interlocking mechanism constructed to provide a contact surface for the snubber and a clearance gap for operational blade movement.

In another aspect of the present invention, a method for attaching snubbers to a rotor assembly comprises: installing a plurality of turbine blades onto a disc comprising a plurality of elongated channels provided therein and spaced along a disc periphery, wherein the plurality of turbine blades each comprise an airfoil, a trailing edge and a leading edge joined by a pressure side and a suction side to provide an outer surface extending in a radial direction to a tip, wherein the plurality of turbine blades are installed in each of the elongated channels on the disc, wherein at least one snubber attachment platform is integrally formed onto the outer surface of each turbine blade airfoil, wherein the at least one snubber attachment platform comprises an interlocking mechanism; and removably attaching a plurality of snubbers, each snubber removably attached into each of the at least one snubber attachment platforms each snubber comprising a first end, a second end, a trailing edge, a leading edge, a snubber length, and a snubber width, wherein each snubber comprises a removable attachment mechanism on at least one of the first end and the second end, wherein each removable attachment mechanism on each snubber connects with the interlocking mechanism on each of the at least one snubber attachment platform, the interlocking mechanism constructed to provide a contact surface for the snubber and a clearance gap for operational blade movement.

These and other features, aspects and advantages of the present invention will become better understood with reference to the following drawings, description and claims.

BRIEF DESCRIPTION OF THE DRAWINGS

The invention is shown in more detail by help of figures. The figures show preferred configurations and do not limit the scope of the invention.

FIGS. 7-9 are various exemplary embodiments of snubber shapes of the present invention.

FIG. 10 is a side cross sectional view of an exemplary embodiment of the present invention taken along line B-B of FIG. 11.

FIG. 12 is a detailed perspective view of a connecting portion shown in FIG. 11.

FIG. 13 is a detailed cross sectional view taken along line A-A of FIG. 12.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Broadly, an embodiment of the present invention provides a removably attachable snubber assembly for turbine blades that includes a turbine blade airfoil including a trailing edge and a leading edge joined by a pressure side and a suction side to provide an outer surface extending in a radial direction to a tip. At least one snubber attachment platform is integrally formed onto the outer surface of the turbine blade airfoil. At least one snubber attachment platform includes an interlocking mechanism. A snubber is removably attachable to the at least one snubber attachment platform, the snubber including a first end, a second end, a trailing edge, a leading edge, a snubber length, and a snubber width. The snubber also includes a removable attachment mechanism on at least one of the first end and the second end that connects with the interlocking mechanism on the at least one snubber attachment platform.

A gas turbine engine may comprise a compressor section, a combustor and a turbine section. The compressor section compresses ambient air. The combustor combines the compressed air with a fuel and ignites the mixture creating combustion products comprising hot gases that form a working fluid. The working fluid travels to the turbine section. Within the turbine section are circumferential rows of vanes and blades, the blades being coupled to a rotor. Each pair of rows of vanes and blades forms a stage in the turbine section. The turbine section comprises a fixed turbine casing, which houses the vanes, blades and rotor. A blade of a gas turbine receives high temperature gases from a combustion system in order to produce mechanical work of a shaft rotation.

Damping is an important benefit that a snubber may provide for a turbine blade. The damping occurs when there is direct contact between adjacent blade snubbers. An aspect of the level of damping is a contact surface. The contact surface is the area of contact between each component. Another phenomena that occurs once the blades are at a certain rotational speed, is that there is radial growth of the airfoil as well as an untwisting at operating conditions.

Improved damping may occur with a snubber that is able to be removed from the blade itself. The snubber, as will be discussed in detail below, may be able to provide a bridge between blades through sliding onto snubber attachment platforms integral to the blades.

Figure 1:
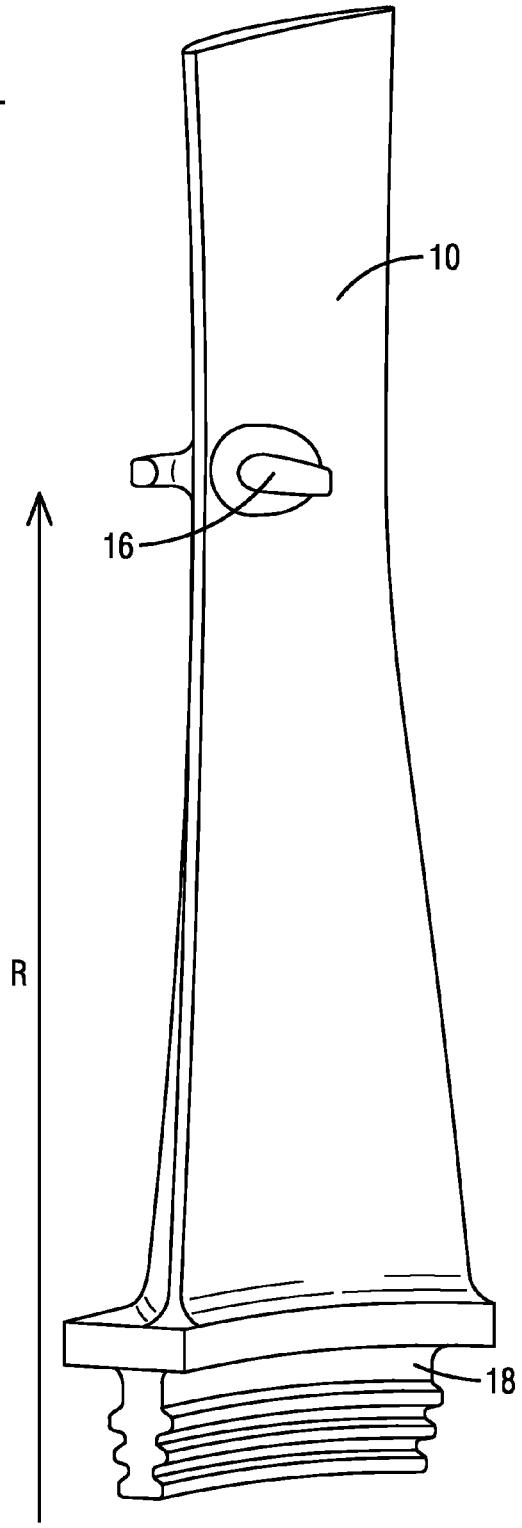
FIG 1 PRIOR ART
FIG. 1 is a perspective view of a prior art blade with snubber.
Figure 2:
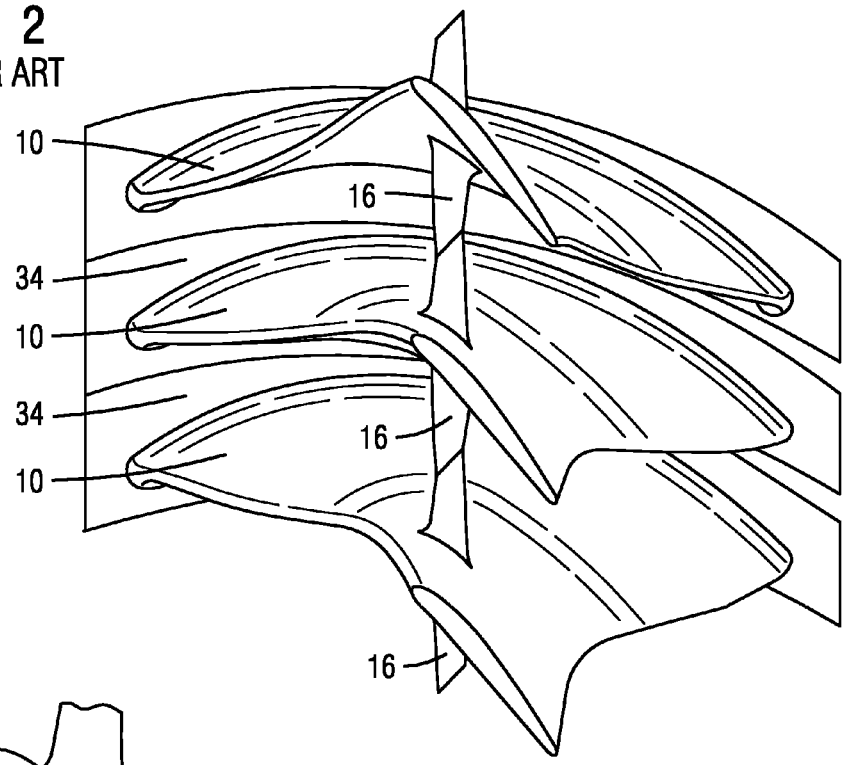
FIG 2 PRIOR ART
FIG. 2 is a radial view of an assembled large last state blade with curved root and integral part span snubber of the prior art.
Figure 3:
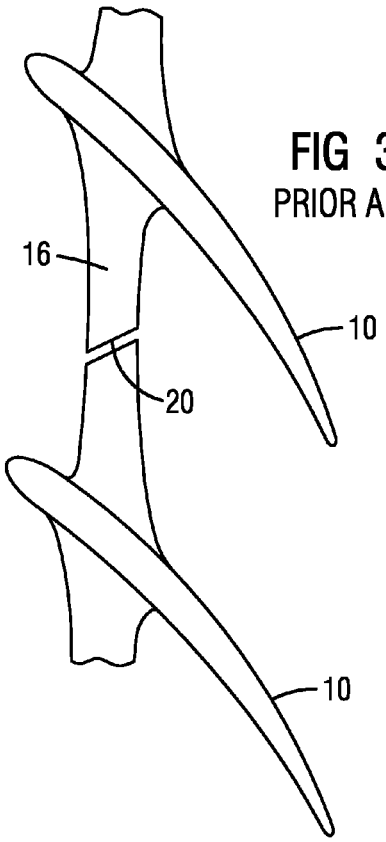
FIG 3 PRIOR ART
FIG. 3 is a perspective view of a prior art snubber and airfoil section.

As is shown in FIGS. 4 through 18, a turbine blade 10 may have an airfoil and may include at least one snubber attachment platform 12 formed along an outer surface 14 of the blade airfoil. The turbine blade 10 may be referred to as the airfoil, or turbine blade airfoil. The turbine blade airfoil may include a trailing edge and a leading edge joined by a pressure side and a suction side to provide the outer surface 14 extending in a radial direction to a tip. A snubber 16 may be a separate part that may be removably inserted between adjacent blades in an assembled wheel, with the wheel having a plurality of blades. The snubber 16 may removeably attach to the at least one snubber attachment platform 12 on each blade 10. The blade airfoil may be one of a plurality of blade airfoils in a row. The blade 10 may have a curved root 18 such as is shown in FIG. 1.

Figure 4:
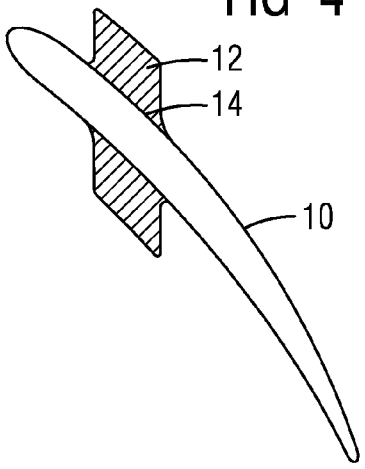
FIGS. 4-6 are various exemplary embodiments of a snubber attachment platform of the present invention.
Figure 5:
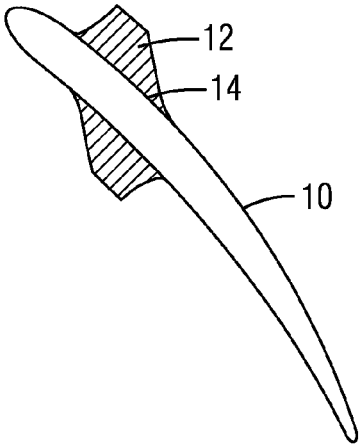
Figure 6:
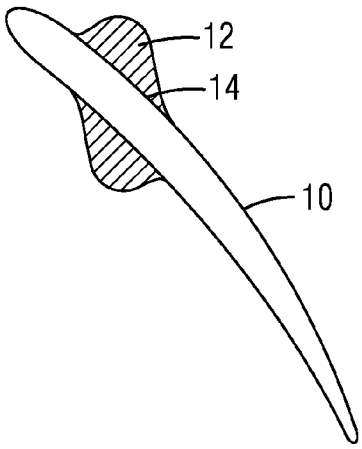

The at least one snubber attachment platform 12 may be integrally formed along the outer surface 14 of the blade airfoil. In certain embodiments, the at least one snubber attachment platform 12 may be positioned along the airfoil at a distance that may equate to a snubber span radius (R) of a conventional snubber blade assembly at a zero speed. The at least one snubber attachment platform 12 may provide the areas of contact and constraint between the plurality of airfoils 10 and a plurality of snubbers 16. The at least one snubber attachment platform 12 may have one of several different shapes in order to fit an application as shown in FIGS. 4-6. At least one snubber attachment platform 12 may have a rectangular shape, a rounded shape, have both straight edges and curves, or the like. The size and shape of each snubber attachment platform 12 may be determined by mechanical and aerodynamic requirements such as the size of the snubber 16, the contact surface for damping, and the airfoil radial growth and untwist at operating conditions. At least one snubber attachment platform 12 shape may be rectangular in shape, polygonal in shape, made with a curvature, or the like. Certain embodiments are shown in FIGS. 4-6.

Figure 7:
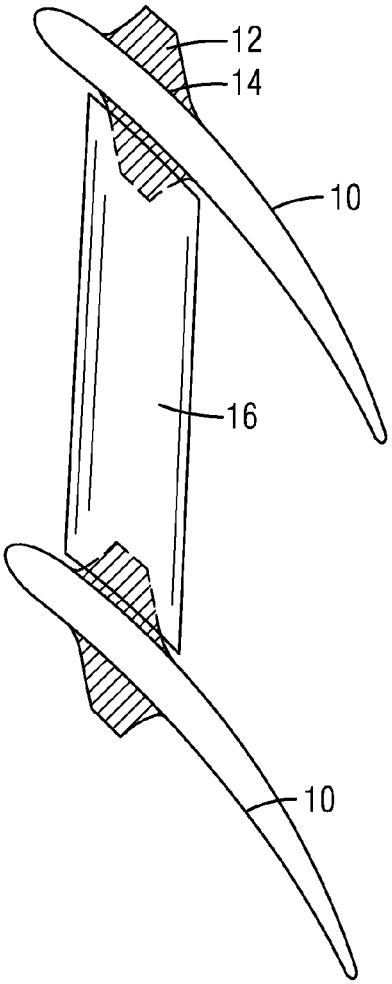

The shape of the snubber 16 may also vary depending on mechanical and aerodynamic requirements. FIGS. 7-9 show different embodiments of the snubber 16. The snubber 16 may have a substantially rectangular shape, a convex shape, a concave shape, or the like.

The plurality of blades 10, may be placed and installed on the wheel. The wheel may include a rotating disc. The disc may include a plurality of elongated channels provided therein and spaced along a disc periphery. Each of the blades 10 may be installed in each of the elongated channels on the disc. The plurality of blades 10 may define a passage 34, having a passage length and a passage width between each blade 10. The snubber 16 may be supported at the airfoils with snubber attachment platform 12 in the passage 34. It may be possible to reduce the aerodynamic blockage of the conventional snubber with a thinner snubber 16. The snubber 16 may have a variable width or thickness in the passage 34 along a circumferential direction. The snubber 16 may have a variable tangential camber within the passage 34 as is shown in FIG. 10.

Figure 11:
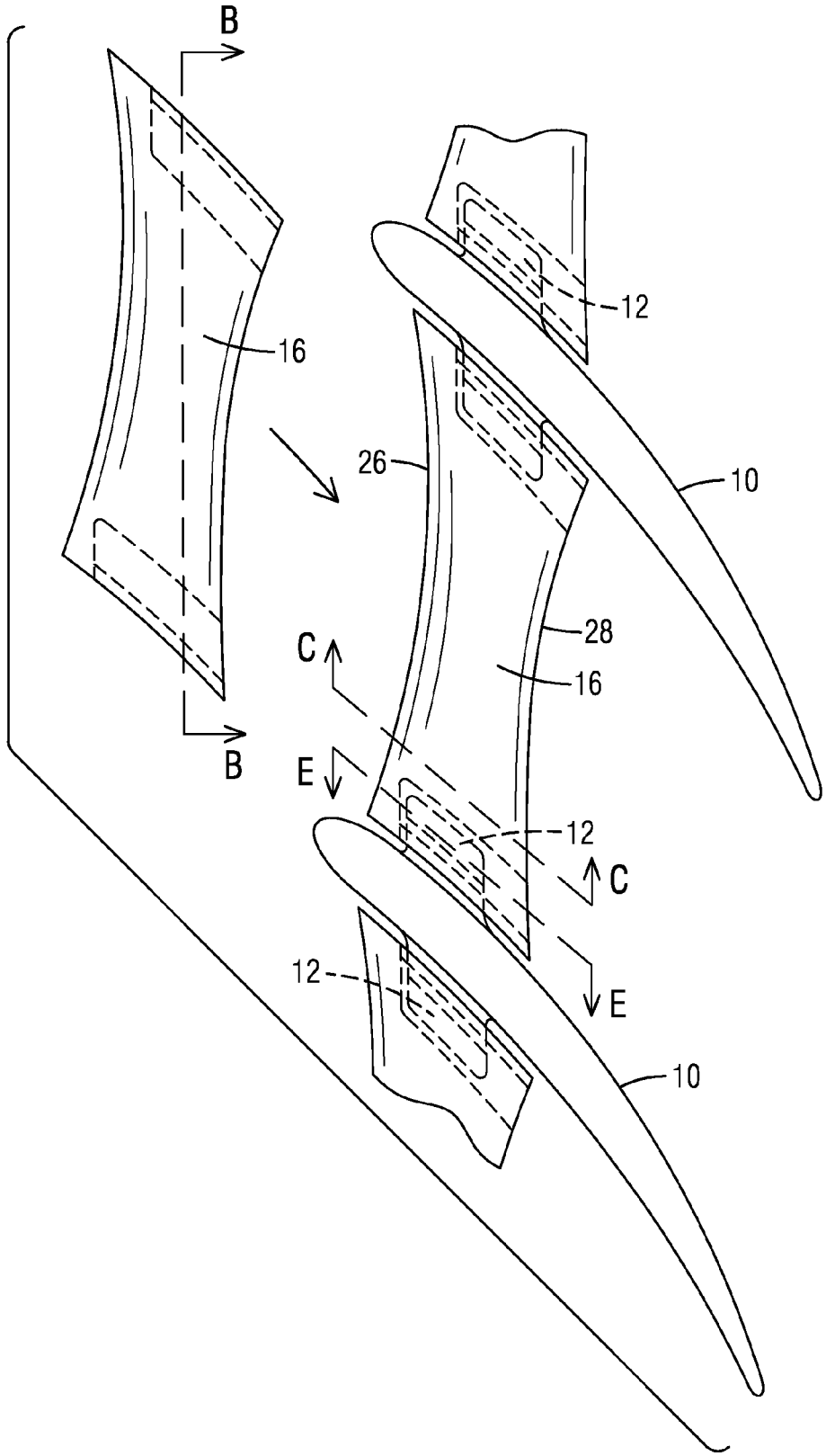
FIG. 11 is a perspective view of a snubber sliding onto a snubber attachment platform of an exemplary embodiment of the present invention.

Each snubber 16 may include a first end 22, a second end 24, a trailing edge 28, a leading edge 26, a snubber chordwise width 30, and a snubber thickness 32. FIG. 11 illustrates how the snubber 16 may be attached to the snubber attachment platform 12, and therefore the blade 10. The snubber thickness 32 and snubber chordwise width 30 are within the passage width and passage length as defined by the space between the blades 10.

The snubber 16 may be removably attached to the snubber attachment platform 12 in multiple embodiments. In certain embodiments, at the first end 22 and the second end 24 of each snubber 16 may be a removable attachment mechanism 36 such as access slots as shown in FIG. 10. The access slots may allow for the snubber 16 to slide onto the snubber attachment platforms 12. Each snubber 16 may slide onto the snubber attachment platform 12 after all blades 10 may be installed on the wheel. Each snubber 16 may be removably attached to the airfoils by the snubber attachment platforms 12. With each attachment, there may be a clearance gap 38 to prevent binding during blade movement such as untwist and radial growth as is shown in FIG. 13. The blade 10 may be allowed to be free to untwist and grow radially without any restriction, or binding, from the snubber 16.

In certain embodiments, the snubber attachment platform 12 may provide an interlocking mechanism 42 such as an interlocking hook with a similar feature on the snubber 16 such as shown in FIGS. 12 and 13. The removable attachment mechanism 36 in this embodiment may include a respective interlocking hook to engage with the interlocking hook of the snubber attachment platform 12. The contact surface may be sized to support the snubber load and to provide a required contact area for damping. In certain embodiments, the mechanism to removably attach a snubber 16 to a snubber attachment platform 12 may be different for the first end 22 of the snubber 16 versus the second end 24 of the snubber 16.

Figure 14:
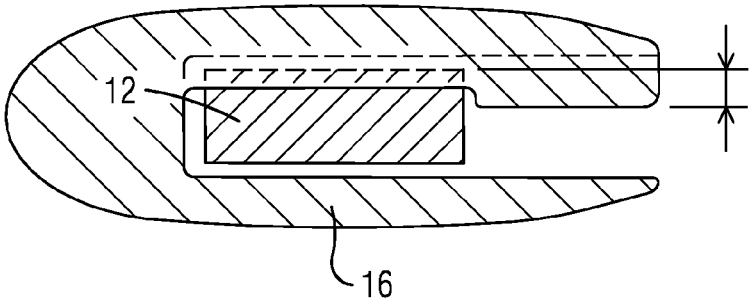
FIGS. 14-16 are cross sectional views of various exemplary embodiments of connecting mechanisms of the present invention taken along line E-E of FIG. 11.

The method of removable attachment may prevent the snubber 16 from sliding off of the support at least one snubber attachment platform 12 during operation. The method may not restrict the airfoil motion, however, for untwisting or radial growth. There are no special fitting requirements between the snubbers 16 of adjacent blades 10. Instead, the snubbers 16 may simply be installed between the blades 10 along the snubber attachment platforms 12. As is illustrated in FIG. 14, in certain embodiments, the interlocking mechanism 42 may be an interference fit that may be between the snubber attachment platform 12 and a trailing edge 28 of the removable attachment mechanism 36. There may be interference when the snubber 16 is first engaged with the snubber attachment platform 12, however, the interference may be aft of the snubber attachment platform 12 when the snubber 16 may be completely installed as is shown.

Figure 15:
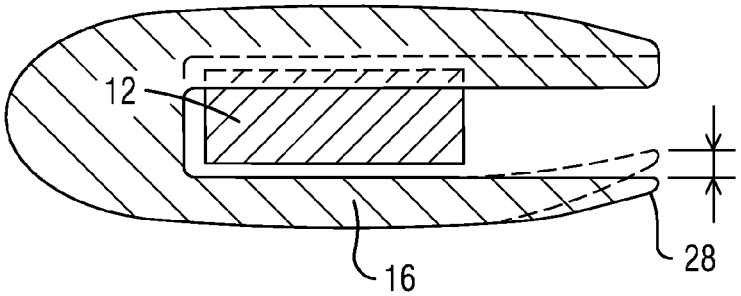
Figure 16:
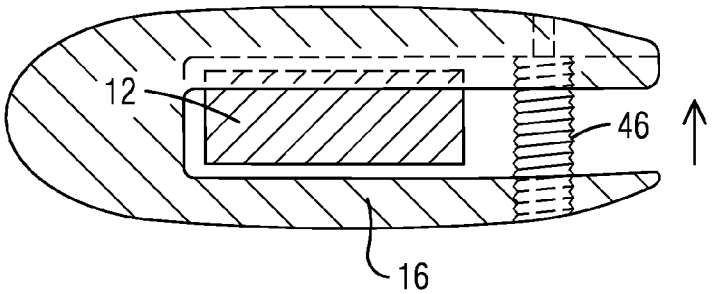

In certain embodiments, the trailing edge 28 of the snubber 16 may be plastically deformed. The first end 22, the second end 24, or both may be plastically deformed to prevent the snubber 16 from sliding off of the snubber attachment platform 12 as is shown in FIG. 15. In other embodiments, a press fit and/or threaded pin 46 may be installed near the trailing edge 28 of the snubber attachment mechanism as is shown in FIG. 16.

The snubbers 16 may have a superior aerodynamic shape compared to snubbers that are integral with the blades 10. Integral snubbers, by their nature, must have a large interface with the contacting snubber in the adjacent blade 10 and that causes aerodynamic losses. As mentioned above, the snubber thickness may be reduced and be provided with a very thin profile. A thinner midsection profile may also reduce aerodynamic blockage.

Figure 19:
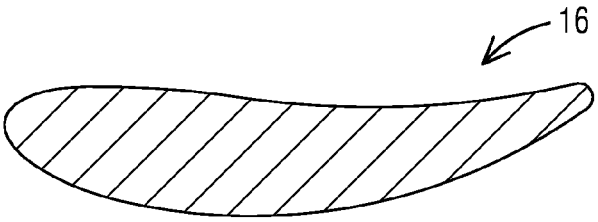
FIG. 19 is a cross sectional view of an airfoil-like cross section of a snubber of an exemplary embodiment of the present invention taken along line C-C of FIG. 11.

In certain embodiments, the snubber 16 may have an airfoil-like cross section such as shown in section C-C of FIG. 11, seen in FIG. 19, in order to produce radially inward directed lift to partially off-set the centrifugal load of the snubber 16. This potential load reduction may be used to improve the blade life, the blade performance via reduced thickness or with a reduced cooling flow.

Figure 17:
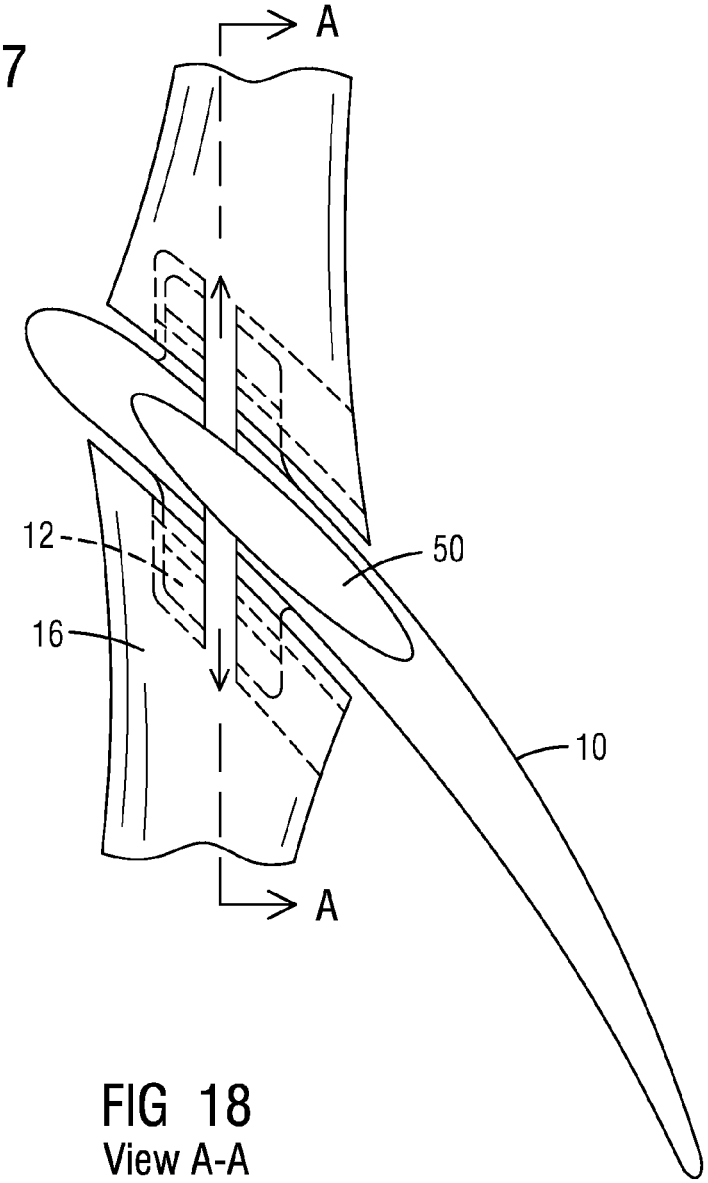
FIG. 17 is a perspective view of an exemplary embodiment of the present invention with air cooling.
Figure 18:
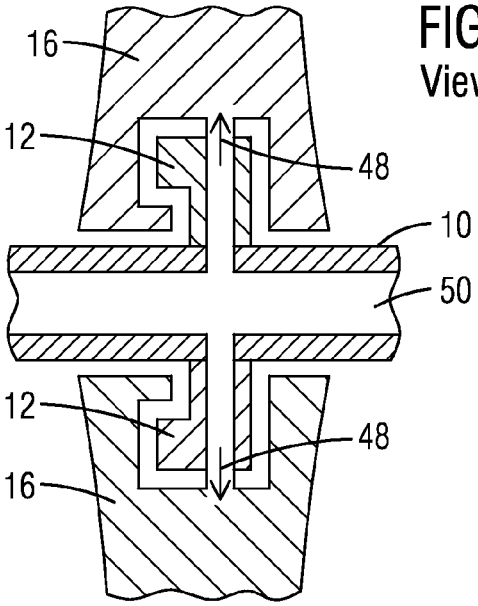
FIG. 18 is a side view of an exemplary embodiment of the present invention with air cooling.

In certain embodiments, the blade 10 may include an air flow cooling circuit. The snubber 16 may be cooled by providing cooling air flow 48 from the blade 10 through the snubber attachment platforms 12 to the snubber 16 as presented in FIGS. 17 and 18. In certain embodiments, the cooling flow may have to jump a gap between the snubber 16 and the snubber attachment platforms 12. Even though the snubber 16 is not a part of the blade 10, the snubber 16 may still be able to receive cooling air flow 48 across the snubber 16 to decrease temperatures. Cooling air flow 48 may run through the airfoil and flow through a cooling cavity 50 with access to the snubber 16 as is shown in FIGS. 17 and 18. The snubber cooling system may be configured to meet design requirements. Additional features may be added to meet the required configuration such as drilled holes, cavities, a trailing edge ejection, a pressure side ejection and the like.

In all embodiments, blade 10 to blade 10 contact is maintained for all operating speeds. There is no need for special tools in order to properly set and assemble the plurality of snubbers 16 in place for proper contact. The plurality of blades 10 may be placed in the wheel, and each snubber 16 may be placed into each snubber attachment platform 12. Once each snubber 16 is placed into each snubber attachment platform 12, there is blade 10 to blade 10 contact. The blade 10 to blade 10 contact may be maintained at all operating speeds, including no speed and at high speeds. Therefore, damping may be available at all operating speeds.

Since the snubber 16 is removable, the snubber 16 may be easily replaced. In certain embodiments, a one interval uncooled part may be placed in position along the snubber attachment platform 12 for temporary placement. Additional cooling flow savings may also be produced with this one interval part.

A thinner snubber 16 than conventionally used may be used and therefore provide improved aerodynamic performance. The thickness necessary in a conventional snubber 16 for contact surface may not be necessary when the snubber 16 may be removably attached to the snubber attachment platform 12, since the snubber attachment platform 12/snubber 16 connection provides the contact surface. The portion of the snubber 16 that is in between the blades 10 may be as thin as possible for the application. The thickness may also be variable for various possibilities such as shown in FIGS. 7-9.

Servicing of the blades 10 and snubbers 16 may improve with the ability to change out the removably attached snubbers 16. Differently shaped snubbers 16 may be placed in service to update or improve performance of the turbine. Instead of having to replace a full blade 10, the snubber 16 alone may be removed and replaced. The easy replacement of snubbers 16 may allow for reduced part life designs that may not require active cooling.

Aeromechanical tuning may be provided for the blades 10 with adjustments to the snubbers 16, or replacement of the snubbers 16 with ease. If problems occur while in service, an individual snubber 16 may be replaced with a different snubber 16 with more damping and or improved shape per the specific application.

As mentioned above, the size and shape of each snubber attachment platform 12 and snubber 16 may be determined by mechanical and aerodynamic requirements. The size of the snubber 16 used in a turbine application may be changed since the snubber 16 may be removed. The contact surface for damping may be reduced due to the change in configuration from the conventional integral snubber. The amount of airfoil radial growth and untwist during operating conditions may change the requirements for the size and shape of the snubber attachment platform 12 and snubber 16.

Optimization may occur with proper testing of the turbine. Mistuning may be used to reduce blade vibration responses. A removably attachable snubber 16 may provide multiple methods to mistune the vibratory response of the blades 10. There may be two or more snubber 16 configurations distributed in the blade passages 34 in order to interfere with coupled blade-to-blade vibration as seen in the formation of a nodal diameter pattern. Each snubber 16 in the turbine blade assembly may be of a different shape, may each have different removable attachment mechanisms 36, or the like. Different snubbers 16 may also change blade natural frequencies. Some of the snubbers 16 may be removed that may eliminate the formation of a coherent nodal diameter pattern.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A removably attachable snubber assembly for turbine blades comprising:

a turbine blade airfoil comprising a trailing edge and a leading edge joined by a pressure side and a suction side to provide an outer surface extending in a radial direction to a tip;

at least one snubber attachment platform integrally formed onto the outer surface of the turbine blade airfoil, wherein the at least one snubber attachment platform comprises an interlocking mechanism; and a snubber comprising a first end, a second end, a trailing edge, a leading edge, a snubber length, and a snubber width, wherein the snubber is removably attachable to the at least one snubber attachment platform through insertion between adjacent airfoils by sliding in a direction from the leading edge towards the trailing edge of the airfoils, wherein the snubber comprises a removable attachment mechanism on at least one of the first end and the second end, wherein the removable attachment mechanism on the snubber connects with the interlocking mechanism on the at least one snubber attachment platform, the interlocking mechanism constructed to provide a contact surface for the snubber and a clearance gap for operational blade movement.

2. The snubber assembly according to claim 1, wherein the removable attachment mechanism is an access slot.

3. The snubber assembly according to claim 1, wherein the snubber width or thickness is variable in a passage between two blades along a circumferential direction.

4. The snubber assembly according to claim 1, further comprising an air flow cooling circuit within the turbine blade airfoil, wherein a cooling cavity in the cooling circuit extends out from the turbine blade airfoil to the snubber.

5. The snubber assembly according to claim 4, wherein a pathway is made from the cooling cavity, through the snubber attachment platform, and into the snubber.

6. The snubber assembly according to claim 1, wherein the snubber attachment platform comprises a rectangular shape along an axial plane.

7. The snubber assembly according to claim 1, wherein the snubber attachment platform comprises a rounded shape along an axial plane.

8. The snubber assembly according to claim 1, wherein the snubber attachment platform comprises straight edges and curves along an axial plane.

9. The snubber assembly according to claim 1, wherein the snubber comprises a rectangular shape along an axial plane.

10. The snubber assembly according to claim 1, wherein the snubber comprises a convex shape along an axial plane.

11. The snubber assembly according to claim 1, wherein the snubber comprises a concave shape along an axial plane.

12. A rotor assembly comprising:

a disc comprising a plurality of elongated channels provided therein and spaced along a disc periphery;

a plurality of turbine blade airfoils, each comprising a trailing edge and a leading edge joined by a pressure side and a suction side to provide an outer surface extending in a radial direction to a tip, wherein each turbine blade airfoil is installed in each of the elongated channels on the disc;

at least one snubber attachment platform integrally formed onto the outer surface of each turbine blade airfoil, wherein the at least one snubber attachment platform comprises an interlocking mechanism; and a plurality of snubbers each comprising a first end, a second end, a trailing edge, a leading edge, a snubber length, and a snubber width, wherein each snubber is removably attachable to at least one snubber attachment platform through insertion between adjacent airfoils by sliding in a direction from the leading edge towards the trailing edge of the airfoils, wherein each snubber comprises a removable attachment mechanism on at least one of the first end and the second end, wherein each removable attachment mechanism on each snubber connects with the interlocking mechanism on each of the at least one snubber attachment platform, the interlocking mechanism constructed to provide a contact surface for the snubber and a clearance gap for operational blade movement.

13. The rotor assembly according to claim 12, wherein each removable attachment mechanism is an access slot.

14. The rotor assembly according to claim 12, wherein each snubber width or thickness is variable in a passage between two blades along a circumferential direction.

15. The rotor assembly according to claim 12, further comprising an air flow cooling circuit within the turbine blade airfoil, wherein a cooling cavity in the cooling circuit extends out from the turbine blade airfoil to the snubber.

16. A method for attaching snubbers to a rotor assembly comprising:

installing a plurality of turbine blades onto a disc comprising a plurality of elongated channels provided therein and spaced along a disc periphery, wherein the plurality of turbine blades each comprise an airfoil, a trailing edge and a leading edge joined by a pressure side and a suction side to provide an outer surface extending in a radial direction to a tip, wherein the plurality of turbine blades are installed in each of the elongated channels on the disc, wherein at least one snubber attachment platform is integrally formed onto the outer surface of each turbine blade airfoil, wherein the at least one snubber attachment platform comprises an interlocking mechanism; and removably attaching a plurality of snubbers through insertion between adjacent airfoils by sliding in a direction from the leading edge towards the trailing edge of the airfoils, each snubber removably attached into each of the at least one snubber attachment platforms, each snubber comprising a first end, a second end, a trailing edge, a leading edge, a snubber length, and a snubber width, wherein each snubber comprises a removable attachment mechanism on at least one of the first end and the second end, wherein each removable attachment mechanism on each snubber connects with the interlocking mechanism on each of the at least one snubber attachment platform, the interlocking mechanism constructed to provide a contact surface for the snubber and a clearance gap for operational blade movement.

* * * * *